US010431397B2

(12) United States Patent
Gutmann

(10) Patent No.: US 10,431,397 B2
(45) Date of Patent: Oct. 1, 2019

(54) SWITCHING CONTACT AND A METHOD OF PRODUCING THE LATTER

(71) Applicant: Tyco Electronics Austria GmbH, Vienna (AT)

(72) Inventor: Markus Gutmann, Brand (AT)

(73) Assignee: Tyco Electronics Austria GmbH, Vienna (AT)

( * ) Notice: Subject to any disclaimer, the term of this patent is extended or adjusted under 35 U.S.C. 154(b) by 153 days.

(21) Appl. No.: 15/220,755

(22) Filed: Jul. 27, 2016

(65) Prior Publication Data

US 2016/0336121 A1 Nov. 17, 2016

Related U.S. Application Data

(63) Continuation of application No. PCT/EP2015/051361, filed on Jan. 23, 2015.

(30) Foreign Application Priority Data

Jan. 28, 2014 (DE) ..... 10 2014 201 533

(51) Int. Cl.

| | |
|---|---|
| ***H01H 3/38*** | (2006.01) |
| ***H01H 11/06*** | (2006.01) |
| ***H01H 1/06*** | (2006.01) |
| *H01H 1/26* | (2006.01) |

(52) U.S. Cl.

CPC ..... *H01H 3/38* (2013.01); *H01H 1/06* (2013.01); *H01H 11/06* (2013.01); *H01H 1/26* (2013.01)

(58) Field of Classification Search

CPC ..... H01H 1/5822; H01H 11/043; H01H 2011/047; H01H 11/045; H01H 1/14; H01H 50/54; H01H 3/38; H01H 1/06; H01H 11/06; H01H 1/26; H01H 51/2281; H01H 50/30

USPC ..... 200/290

See application file for complete search history.

(56) References Cited

U.S. PATENT DOCUMENTS

| | | | | |
|---|---|---|---|---|
| 2,682,594 A | | 6/1954 | Huetten | |
| 2,686,954 A | | 6/1954 | Parker | |
| 2,740,735 A | * | 4/1956 | Swain | H01H 1/02 148/532 |
| 3,041,118 A | * | 6/1962 | Campbell | H01H 11/045 200/283 |
| 3,339,048 A | | 8/1967 | Haderer | |
| 4,342,893 A | | 8/1982 | Wolf | |
| 5,324,901 A | | 6/1994 | Hendel et al. | |

(Continued)

FOREIGN PATENT DOCUMENTS

| | | |
|---|---|---|
| CN | 101231923 A | 7/2008 |
| CN | 201435353 Y | 3/2010 |
| CN | 202977311 U | 6/2013 |

(Continued)

OTHER PUBLICATIONS

German Office Action, dated Sep. 29, 2014, 5 pages.

(Continued)

*Primary Examiner* — Edwin A. Leon

(74) *Attorney, Agent, or Firm* — Barley Snyder

(57) ABSTRACT

A contact for an electrical switch has a first spring with an upper side and an opposite lower side, a second spring layered on the lower side, and a contact element located on the upper side and bonded to the second spring.

20 Claims, 4 Drawing Sheets

(56) References Cited

U.S. PATENT DOCUMENTS

| | | | |
|---|---|---|---|
| 5,369,235 | A | 11/1994 | Hendel |
| 2009/0033446 | A1 | 2/2009 | Gruner et al. |

FOREIGN PATENT DOCUMENTS

| | | | |
|---|---|---|---|
| CN | 202996731 | U | 6/2013 |
| DE | 8433394 | U1 | 3/1985 |
| DE | 3608314.3 | | 9/1987 |
| JP | 0355725 | A | 3/1991 |
| JP | H05-74262 | A | 3/1993 |
| JP | 05242752 | A | 9/1993 |
| JP | H09-45176 | A | 2/1997 |
| JP | H09-320379 | A | 12/1997 |
| WO | 2010090619 | A2 | 8/2010 |

OTHER PUBLICATIONS

PCT Notification, International Search Report and Written Opinion, dated Mar. 10, 2015, 7 pages.
Machine generated translation of CN101231923, dated Jul. 30, 2008, 5 pages.
Abstract of JP05242752, dated Sep. 21, 1993, 2 pages.
Abstract of JP0355725, dated Mar. 11, 1991, 2 pages.
Chinese Office Action and English translation, dated May 27, 2015, 21 pages.
Japanese Notice of Reasons for Refusal with English translation, Japanese Patent Application No. 2016-548094, dated Dec. 4, 2018, 8 pages.
Abstract of JPH0574262A, dated Mar. 26, 1993, 1 page.
Abstract of JPH0945176A, dated Feb. 14, 1997, 1 page.
Abstract of JPH09320379A, dated Dec. 12, 1997, 1 page.

* cited by examiner

SWITCHING CONTACT AND A METHOD OF PRODUCING THE LATTER

CROSS-REFERENCE TO RELATED APPLICATIONS

This application is a continuation of PCT International Patent Application No. PCT/EP2015/051361, filed Jan. 23, 2015, which claims priority under 35 U.S.C. § 119 to German Patent Application No. 102014201533.2, filed Jan. 28, 2014.

FIELD OF THE INVENTION

The present invention relates to an electrical switch, and more particularly, to a contact of an electrical switch.

BACKGROUND

Electrical switch contacts having a spring and a contact element connected to the spring, along with methods for producing such contacts, are known in the prior art. The contacts are fastened to brackets to form contact assemblies, which perform switching functions in electric switches such as relays or contactors. The switches have drive devices which move the contacts to electrically connect with or release from counter contacts.

In certain applications, such as metering relays, high demands are made of the current-carrying capacity of the contacts. An electric current is transmitted from the bracket via the spring to the contact element, and on to the counter contact element. The contact element is designed to have optimal electric transmission properties, while the spring is optimized to provide a force releasing the contact from the counter contact. The spring is thus generally produced from a material that has the best possible spring properties and sufficient electrical conductivity, such as CuCrSiTi.

The spring and contact element should be connected to one another as securely as possible in order to guarantee the best possible current transfer between them. However, particularly in light of the constant endeavours to miniaturize contact assemblies, it is increasingly difficult to produce a sufficiently stable connection between the spring and the contact element. As an alternative to known rivet connections, single-layer springs are also welded to contact elements. Electrical transfer resistance in the weld is lower, which is also reflected in a thermal advantage, leading to greater long-term connection stability between the contact element and spring. However, welding has not been used with multi-layered springs, such as coated springs, because welding has not been sufficiently precise in the connection between spring layers.

SUMMARY

An object of the invention, among others, is to provide a miniaturized contact for an electrical switch having a stable connection between multiple layers of springs and contact elements. The disclosed contact comprises a first spring having an upper side and an opposite lower side, a second spring layered on the lower side, and a contact element disposed on the upper side and bonded to the second spring.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a contact of an electrical switch. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
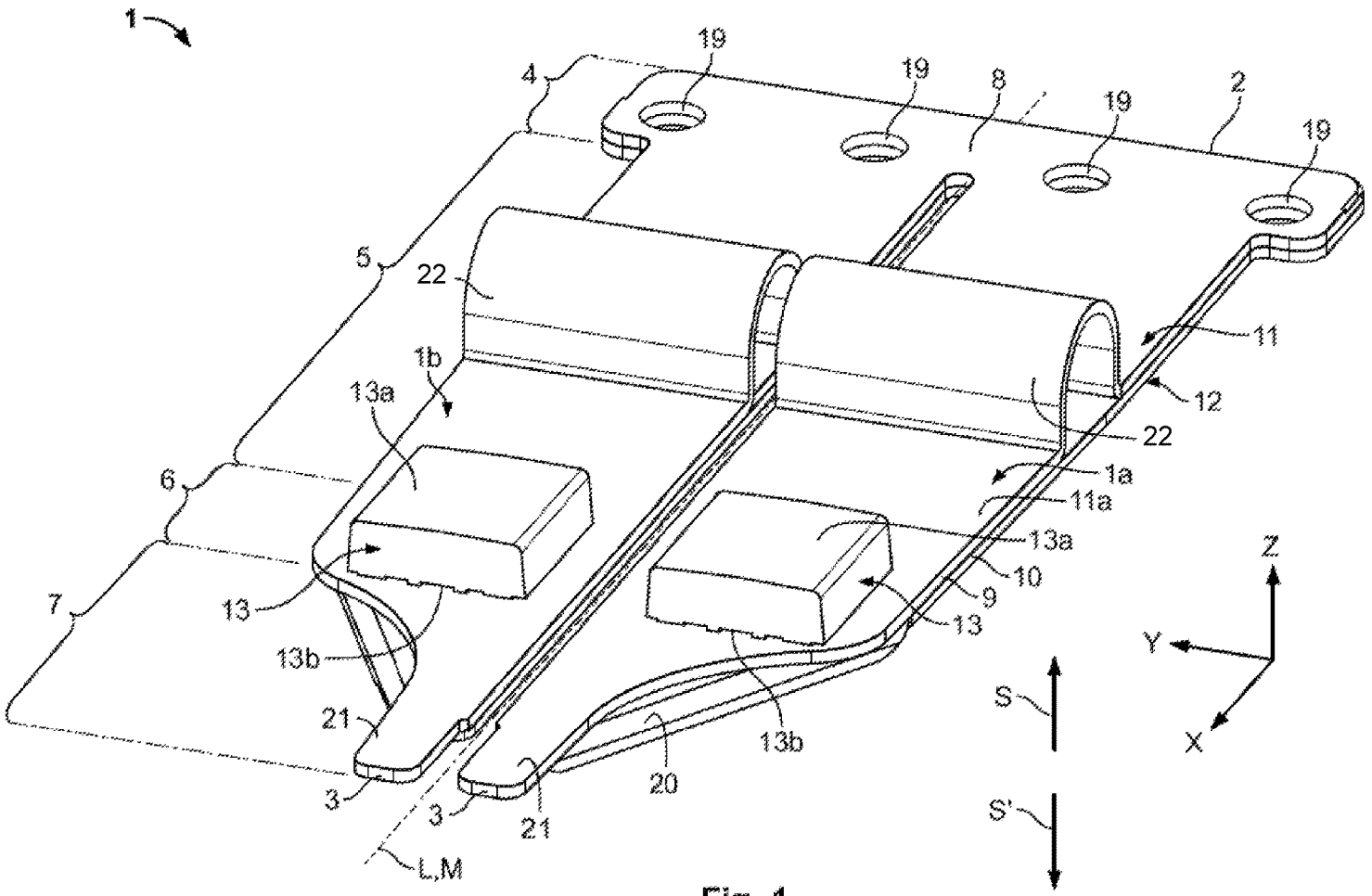
FIG. 1 is a perspective view of a contact according to the invention.

A contact 1 according to the invention is shown generally in FIG. 1. The contact 1 extends from a fastening end 2 to an opposite actuating end 3. A longitudinal axis L or center axis M of the contact 1 extends parallel to the longitudinal direction X shown in FIG. 1. The longitudinal direction X, the transverse direction Y and the height direction Z together form a Cartesian coordinate system.

Figure 5:
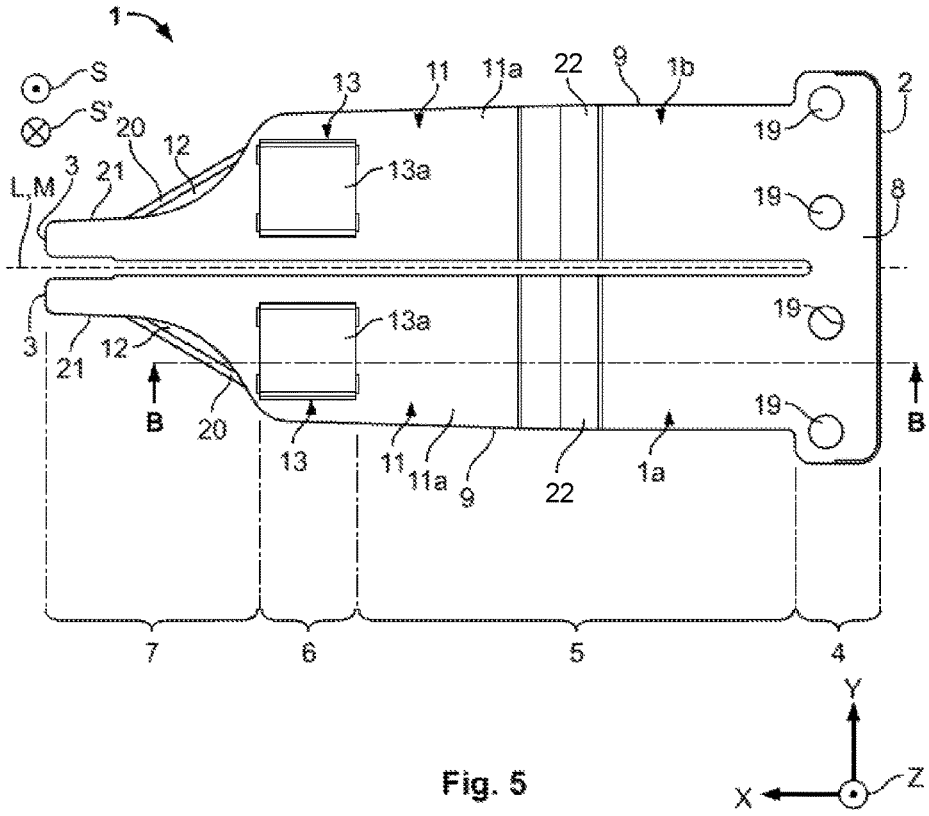
FIG. 5 is a plan view of the contact of FIG. 1.

The contact 1 has a first switching unit 1*a* and a second switching unit 1*b*. Although two switching units 1*a*, 1*b* are described with respect to the shown embodiment, the contact 1 can have any number of switching units 1*a*, 1*b*, configured as otherwise described herein. The switching units 1*a*, 1*b* are arranged next to one another in a transverse direction Y running perpendicularly to the longitudinal direction X and are connected to one another by a bridge 8. The switching units 1*a*, 1*b*, in the shown embodiment, are mirrored about the center axis M, as also shown in FIG. 5. The contact 1, in each switching unit 1*a*, 1*b*, has a first layer 9 and a second layer 10 which are arranged positioned one over the other in a height direction Z shown in FIG. 1. The first layer 9 is formed by a first spring 11, and the second layer 10 is formed by a second spring 12.

The first switching unit 1*a* and the second switching unit 1*b* form, from the fastening end 2 to the actuating end 3, a fastening section 4, a spring section 5, a contact section 6, and an actuation section 7. The sections of the contact 1 will now be described in greater detail from the fastening end 2 to the actuating end 3.

In the fastening section 4, as shown in FIG. 1, fastening openings 19 in the form of through holes extend in the height direction Z through the first spring 11 and the second spring 12. Fasteners (not shown) may be positioned to extend through the fastening openings 19 to connect the first spring 11 and the second spring 12, for example by a force-fit or frictionally engaged connection. The fasteners (not shown) may be known fasteners such as rivets or screws. In the shown embodiment, the contact 1 has four fastening openings 19, but any number of fastening openings may be used.

In the spring section 5, as shown in FIG. 1, the first spring 11 in each switching unit 1*a*, 1*b* is respectively provided with a bend 22. The bends 22 reinforce counter spring or reset forces Fs acting in a counter switching direction S' opposing a switching direction S shown in FIG. 1.

Figure 2:
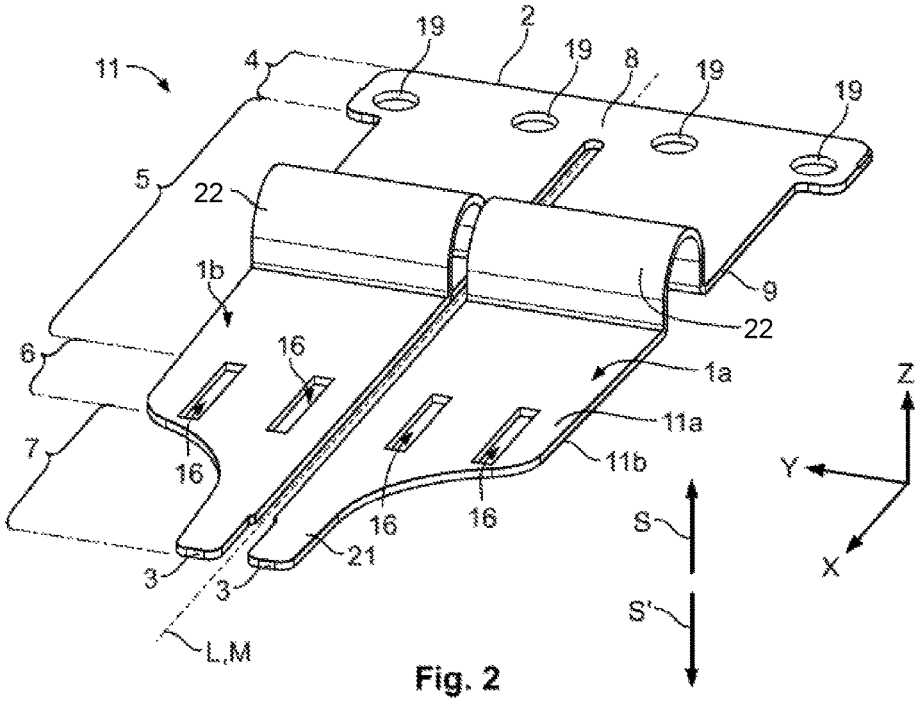
FIG. 2 is a perspective view of a first spring of the contact of FIG. 1.
Figure 3:
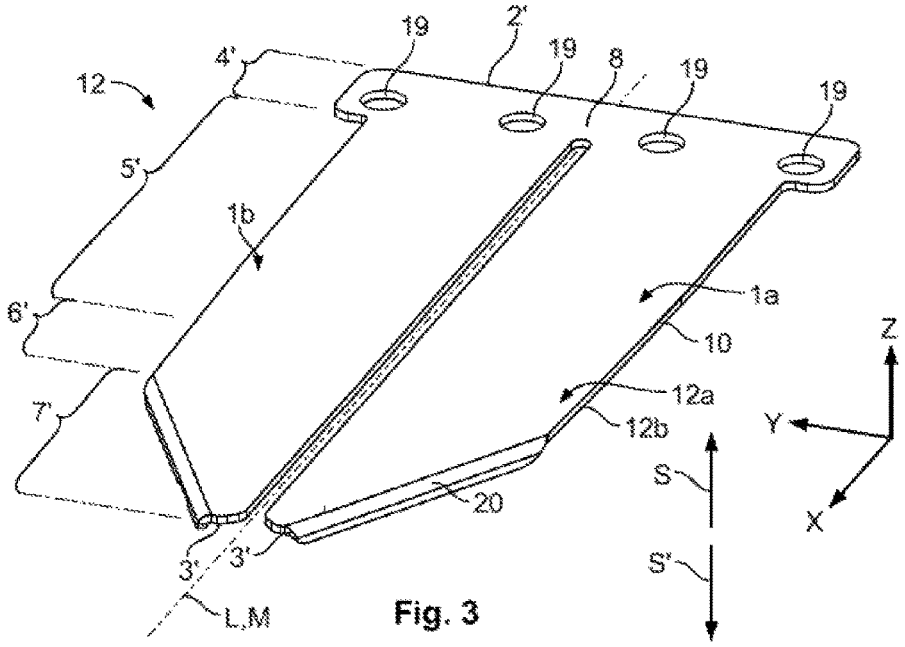
FIG. 3 is a perspective view of a second spring of the contact of FIG. 1.

As shown in FIG. 2, in each switching unit 1*a*, 1*b*, the first spring 11 has openings 16 in the contact section 6. In the shown embodiment, the openings 16 extend in the height direction Z from an upper side 11*a* to a lower side 11*b*. The openings 16 form a rectangular slot in the longitudinal direction X extending a length of the contact section 6. In the present exemplary embodiment shown in FIG. 2, two openings 16 are provided for each switching unit 1*a*, 1*b*, however, the first spring 11 may have any number of openings 16. As shown in FIG. 3, in the contact section 6' of the second spring 12, no special features are provided for the fastening of the contact elements 13; an upper side 12*a* of the second spring 12 is substantially planar in the region of its contact section 6'.

Figure 4:
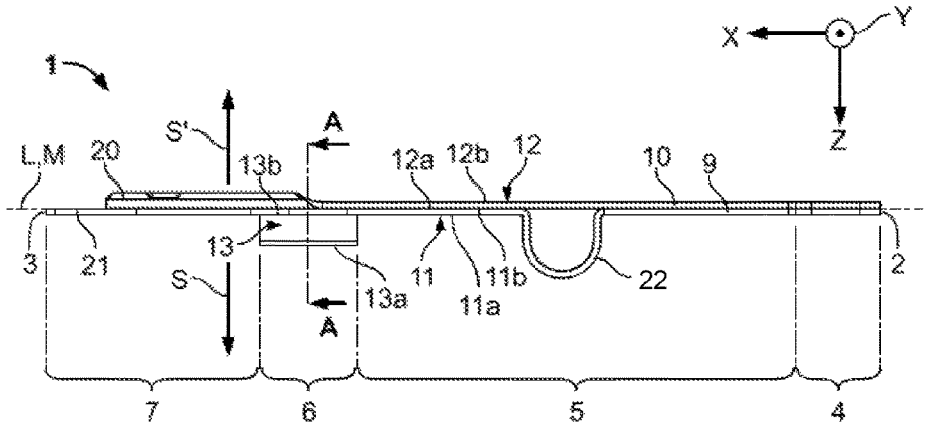
FIG. 4 is a side view of the contact of FIG. 1.

Each switching unit 1*a*, 1*b* has a contact element 13 disposed in the contact section 6. Each contact element 13, as shown in FIG. 1, has a switching surface 13*a* and a fitting side 13*b*. The switching surface 13*a* faces the switching direction S shown in FIG. 1 running parallel to the height direction Z. The fitting side 13*b* is disposed on an upper side 11*a* of each first spring 11 in the contact section 6. As shown in FIG. 4, in the contact section 6, the first spring 11 is held between the contact element 13 and the second spring 12.

Figure 6:
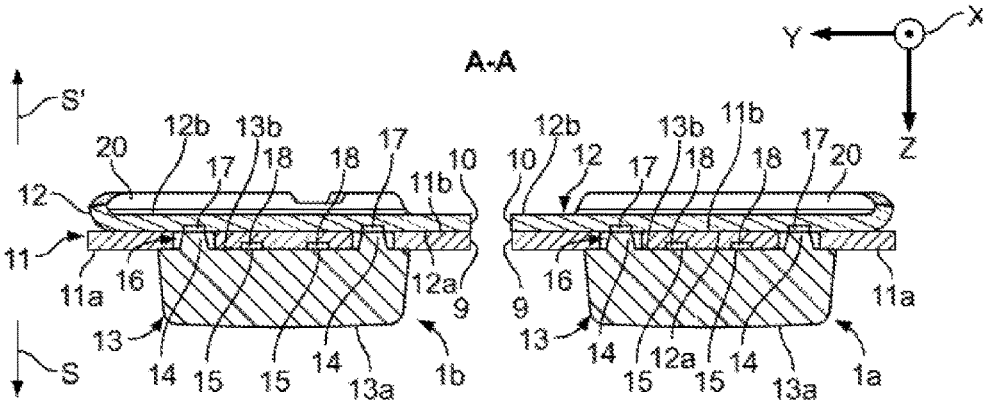
FIG. 6 is a sectional view of the contact of FIG. 1, taken along line A-A of FIG. 4.

As shown in FIG. 6, each contact element 13 also has first projections 14 and second projections 15 moulded onto the fitting side 13*b*. In the shown embodiment, each contact element 13 has two first projections 14 and two second projections 15, however, the contact element 13 may have any number of first projections 14 and second projections 15. The first projections 14 may be formed as ribs on the fitting side 13*b*.

The first projections 14 extend through the openings 16 and are bonded to the second spring 12. The bonding of the first projections 14 and the second spring 12 may be formed by first welds 17. The length of each first projection 14 in the longitudinal direction X may correspond, for example, to the length of the opening 16 in the longitudinal direction X. The second projections 15, in the embodiment shown in FIG. 6, are positioned between the first projections 14 on the fitting side 13*b*. The second projections 15 are bonded to the first spring 11. The bonding of the second projections 15 and the first spring 11 may be formed by second welds 18. The first welds 17 and the second welds 18 may be seam welds extending parallel to the longitudinal direction X. Alternatively, before welding the first welds 17 and the second welds 18, a solder layer (not shown) can be applied to the contact element 13 and/or to the first and second spring 11, 12 in order to bring about hard soldering of the contact element 13 and the springs 11, 12. Each contact element 13 is thus welded both to the first spring 11 and to the second spring 12 of one switching unit 1*a*, 1*b*.

Figure 7:
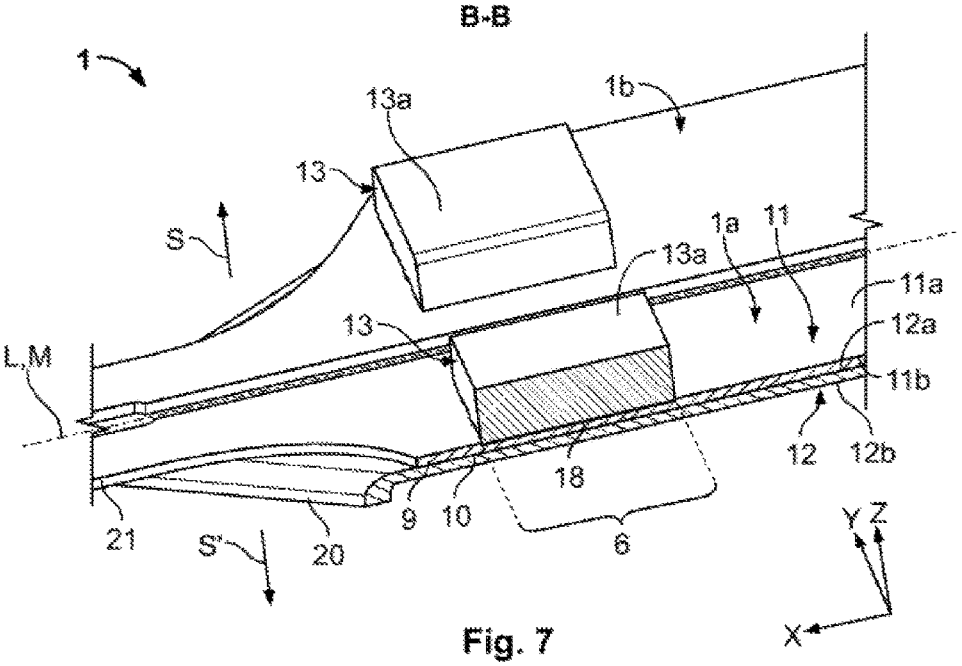
FIG. 7 is a perspective sectional view of the contact of FIG. 1, taken along line B-B of FIG. 5.

The second weld 18 can be formed from the second projection 15, which may melt away when welded to the upper side 11*a* of the first spring 11 to such an extent that the contact element 13 lies with its fitting site 13*b* flat on the upper side 11*a*, as shown in FIG. 7. If the second projection 15 does not completely melt away, it can contribute at least to tight clamping of the first spring 11 between the contact element 13 and the second spring 12.

The first and second layers 9, 10 or the first and second springs 11, 12 can, for example, have a thickness of approximately one tenth of a millimeter measured parallel to the height direction Z. The projections 14 can have a height of, for example, up to four tenths of a millimeter, likewise measured parallel to the height direction Z, so as to pass through the openings 16 with an overfeed of for example six to ten hundredths of a millimeter. The additional projections 15 can have a height of four to eight hundredths of a millimeter before welding, likewise measured parallel to the height direction Z, in order to lie over the upper side 11*a* and to melt away optimally during welding.

As shown in FIG. 3, in comparison to the actuation section 7 of the first spring 11 shown in FIG. 2, the actuation section 7' of the second spring 12 is slightly shortened so that the actuation end 3' of the second spring 12 ends before the actuation end 3 of the first spring 11 in longitudinal direction X.

In the actuation region 7, as shown in FIGS. 1 and 3, each switching unit 1*a*, 1*b* has a reinforcement structure 20 in the form of a bent-over edge moulded onto the second spring 12 and pointing in the counter switching direction S'. The second spring 12 may have any number of reinforcement structures 20. The reinforcement structure 20 supports a free end 21 formed on the first spring 11 projecting over the second spring 12 in the longitudinal direction X. The free end 21 can be bent in the switching direction S by an actuation device (not shown). Such bending allows an overstroke when the switching surface 13*a* of the contact element 13 is resting against a counter switching surface of a counter contact element (not shown) in a closed state of a switch (not shown).

Advantageously, in the contact 1 of the present invention, a tight connection between the contact element 13 and the first and second springs 11, 12 is produced which has great stability, sturdiness and very good electric conductivity.

What is claimed is:

1. A contact for an electrical switch, comprising:

a first spring having an upper side, an opposite lower side, a first switching unit and a second switching unit, the first switching unit and the second switching unit arranged next to one another in a transverse direction perpendicularly to a longitudinal direction, the second switching unit connected to the first switching unit by a bridge in the transverse direction;

a second spring layered on the lower side of the first spring, and planar region of a contact section along an upper side of the second spring, the second spring having a first switching unit and a second switching unit, connected to the first switching unit by a bridge; and a contact element disposed on the upper side of the first spring and bonded to the upper side of the second spring along the planar region.

2. The contact of claim 1, wherein the contact element extends through the first spring.

3. The contact of claim 2, wherein the contact element extends through an opening in the first spring.

4. The contact of claim 3, wherein the contact element has a first projection.

5. The contact of claim 4, wherein the first projection is moulded onto the contact element.

6. The contact of claim 5, wherein the first projection extends through the opening.

7. The contact of claim 6, wherein the first projection is welded to the second spring.

8. The contact of claim 7, wherein the first projection is a rib.

9. The contact of claim 8, wherein the opening is a slot.

10. The contact of claim 7, wherein the contact element is welded to the first spring.

11. The contact of claim 10, wherein the contact element has a second projection.

12. The contact of claim 11, wherein the second projection is moulded onto the contact element.

13. The contact of claim 12, wherein the second projection is welded to the first spring.

14. The contact of claim 13, wherein the contact element is welded to the first spring and the second spring along a plurality of weld seams extending substantially parallel to a longitudinal axis of the first spring and the second spring.

15. The contact of claim 13, wherein the bridge has a plurality of fastening openings.

16. The contact of claim 13, wherein the first spring has a bend disposed in each of the first switching unit and the second switching unit.

17. The contact of claim 13, wherein the first spring extends to a free end beyond the second spring in a longitudinal direction.

18. The contact of claim 17, wherein the second spring has a reinforcement structure supporting the free end.

19. The contact of claim 13, further comprising a plurality of contact elements.

20. The contact of claim 19, wherein one contact element is disposed on each of the first switching unit and the second switching unit of the first spring.

* * * * *